US007636073B2

(12) United States Patent
Ono et al.

(10) Patent No.: US 7,636,073 B2
(45) Date of Patent: Dec. 22, 2009

(54) IMAGE DISPLAY APPARATUS AND METHOD OF DRIVING SAME

(75) Inventors: Shinya Ono, Yokohama (JP); Yoshinao Kobayashi, Kanagawa (JP)

(73) Assignees: Kyocera Corporation, Kyoto (JP); Chi Mei Optoelectronics Corp. (TW)

( * ) Notice: Subject to any disclaimer, the term of this patent is extended or adjusted under 35 U.S.C. 154(b) by 758 days.

(21) Appl. No.: 11/159,328

(22) Filed: Jun. 23, 2005

(65) Prior Publication Data

US 2006/0007074 A1 Jan. 12, 2006

(30) Foreign Application Priority Data

Jun. 25, 2004 (JP) ..... 2004-188834

(51) Int. Cl.
*G09G 3/30* (2006.01)

(52) U.S. Cl. ..... 345/76; 345/77; 345/78; 345/79; 345/80; 345/81; 345/82; 345/83; 345/204; 315/169.3

(58) Field of Classification Search ..... 345/76–83, 345/84, 204; 315/169.3
See application file for complete search history.

(56) References Cited

U.S. PATENT DOCUMENTS 6,229,508 B1 * 5/2001 Kane ..... 345/82
6,798,147 B2 * 9/2004 Yang ..... 315/169.1
6,806,852 B2 * 10/2004 Ishizuka et al. ..... 345/77
6,859,193 B1 * 2/2005 Yumoto ..... 345/82
6,876,345 B2 * 4/2005 Akimoto et al. ..... 345/76
7,046,240 B2 * 5/2006 Kimura ..... 345/212
7,109,982 B2 * 9/2006 Kim et al. ..... 345/208
7,122,970 B2 * 10/2006 Ono et al. ..... 315/169.3
7,129,643 B2 * 10/2006 Shin et al. ..... 315/169.3
7,184,065 B2 * 2/2007 Shin ..... 345/690
7,259,735 B2 * 8/2007 Kasai ..... 345/77
7,319,447 B2 * 1/2008 Hsueh ..... 345/82
2004/0041823 A1 * 3/2004 Shin ..... 345/690
2004/0070557 A1 * 4/2004 Asano et al. ..... 345/76
2004/0217925 A1 * 11/2004 Chung et al. ..... 345/76
2005/0024351 A1 * 2/2005 Sano ..... 345/204

FOREIGN PATENT DOCUMENTS

CN 1573887 A 2/2005
JP 2003-140612 A 5/2003
WO WO0106484 * 1/2001

* cited by examiner

*Primary Examiner*—Richard Hjerpe
*Assistant Examiner*—Grant D Sitta
(74) *Attorney, Agent, or Firm*—Birch, Stewart, Kolasch & Birch, LLP

(57) ABSTRACT

An image display apparatus includes a light emitting element that emits light depending on an injected electric current; a driver that includes at least a first terminal and a second terminal, and controls the light emitting element based on a potential difference, applied between the first terminal and the second terminal, of a level higher than a predetermined threshold; a storage capacitor that serves to retain a potential on the first terminal of the driver; and a controller that changes the potential on the first terminal via the storage capacitor at writing of electric data current corresponding to a display in a black level.

11 Claims, 15 Drawing Sheets

IMAGE DISPLAY APPARATUS AND METHOD OF DRIVING SAME

BACKGROUND OF THE INVENTION

1. Field of the Invention

The present invention relates to an image display apparatus, and more particularly to an image display apparatus which allows improvement in response speed at data writing for a display in a black level without being affected by constraint in area per pixel.

2. Description of the Related Art

Conventionally, proposals have been made to realize an image display apparatus provided with organic light-emitting diodes (OLEDs) which emit light by recombination of positive holes and electrons injected into a light emitting layer.

FIG. 14 is a diagram of a structure of a pixel-circuit corresponding to one pixel in the conventional image display apparatus. The pixel circuit of FIG. 14 includes an OLED 1, a switching element 2, a driver element 3, a switching element 4, a switching element 5, a gate signal line 6, a gate signal line 7, a source signal line 8, an electroluminescent (EL) power source line 9, and a storage capacitor 1Cs. It should be noted that in a first part of the description on the conventional image display apparatus, the pixel circuit does not include a capacitor 1Ct (shown as surrounded by a broken line).

The OLED 1 has characteristics of emitting light when a potential difference equal to or higher than a threshold voltage is generated between an anode and a cathode to cause an electric current flow therein. Specifically, the OLED 1 includes at least an anode layer and a cathode layer formed from a material such as Al, Cu, and Indium Tin Oxide (ITO), and a light emitting layer formed from an organic material such as phthalcyanine, tris-aluminum complex, benzoquinolinolato, and beryllium complex, and functions to emit light by recombination of positive holes and electrons injected into the light emitting layer.

The switching elements 2, 4, and 5, and the driver element 3 are thin film transistors (TFT).

In the pixel circuit with the above-described structure, in a data writing period the switching elements 4 and 5 are turned ON whereas the switching element 2 is turned OFF. Then, when a programming electric current $i_d$ is applied via the source signal line 8, the electric current $i_d$ flows through a path formed by the EL power source line 9, the driver element 3, the switching element 4, and the source signal line 8 in this order. A gate potential $V_G$ of the driver element 3 is determined according to the amount of the electric current $i_d$ flowing along the source signal line 8. Thus, electric charges of an amount corresponding to the gate potential $V_G$ are accumulated in the storage capacitor 1Cs.

In a light emitting period following the data writing period, the switching elements 4 and 5 are turned OFF whereas the switching element 2 is turned ON. Then, an electric current $i_d$ of the same amount as the programming electric current applied in the data writing period flows through the OLED 1. If the amount of electric current $i_d$ flowing through the source signal line 8 changes in the data writing period, the amount of electric charges accumulated in the storage capacitor 1Cs changes, thereby changing the amount of electric current $i_{OL}$ in the light emitting period to change the luminance of the OLED 1.

When the OLED 1 performs an image display apparatus in a black level, for example, the amount of the electric current $i_d$ flowing through the source signal line 8, i.e., an amount of an electric current for the black level display, is in the range of 1.5 nA to 29 nA. When the OLED 1 performs an image display apparatus in a white-level, the amount of the electric current $i_d$ flowing through the source signal line 8, i.e., an amount of an electric current for the white level display, is approximately in the range of a few 100 nA to a few μA depending on an efficiency of the OLED 1, panel luminance, and resolution.

The display in the black level with a small programming electric current $i_d$ causes rounding of the waveform of $i_d$ due to a time constant defined by a resistance of the driver element 3 and a parasitic floating capacitance of the source signal line 8, whereby the amount of the electric current $i_d$ does not reach a predetermined level immediately. To deal with this inconvenience, the conventional image display apparatus is required to have a long data writing period, resulting in a slow response speed.

To eliminate such inconvenience, the gate of the driver element 3 and the gate of the switching element 4 of FIG. 14 may be connected (capacitance-coupled) via the capacitor 1Ct (shown in broken line) to improve the response speed as is conventionally proposed.

With this proposed structure, in the data writing period the switching elements 4 and 5 are turned ON whereas the switching element 2 is turned OFF. Then, the electric current $i_d$ flows into the source signal line 8. Specifically, the electric current $i_d$ flows along a path formed by the EL power source line 9, the driver element 3, the switching element 4, and the source signal-line 8, in this order.

In the subsequent light emitting period, the switching elements 4 and 5 are turned OFF whereas the switching element 2 is turned ON. Then, because of the presence of the capacitor 1Ct, the gate potential $V_G$ of the driver element 3 changes according to the potential variation on the gate signal line 6.

Variation $\Delta V_G$ of the gate potential $V_G$ here can be represented as $\Delta V_G = \Delta V_{gg} \times (C_{gs} + Ct)/(C_{gs} + Ct + Cs)$ where $C_{gs}$ represents a gate-to-source capacitance of the switching element 5. Here, Ct is a capacitance of the capacitor 1Ct, Cs is a capacitance of the capacitor 1Cs, and $\Delta V_{gg}$ is a variation in potential on the gate signal line 6.

At the transition from the data writing period to the light emitting period, the potential on the gate signal line 6 rises to increase the gate potential $V_G$ of the driver element 3. The amount of increase varies according to the three values of capacitance. Since $C_{gs}$ is determined based on the size and the structure of the switching element 5, elements that actually control the amount of increase are the capacitor 1Ct and the storage capacitor 1Cs.

Further, the increase in the gate potential of the driver element 3 causes the drain current decrease. The drain current of the driver element 3 drops by an amount corresponding to the variation $\Delta V_G$. Hence, the amount of the electric current $i_{OL}$ flowing through the OLED 1 is smaller than a predetermined amount when the switching element 2 is turned ON.

In other words, a larger amount of the electric current $i_d$ than the predetermined amount is required to be applied to the transistor 3 in the data writing period in order to cause electric current flow of the predetermined amount in the OLED 1 in the light emitting period. The amount of the electric current $i_d$ can be increased if the storage capacitor 1Cs is smaller or the capacitor 1Ct is larger.

When the storage capacitor 1Cs is smaller, the capacity to retain the electric charges decreases, which makes fluctuation in the gate potential $V_G$ of the driver element 3 more likely. Thus, since the smaller storage capacitor 1Cs is not a realistic solution, the larger capacitor 1Ct is preferable.

When the amount of the electric current $i_d$ flowing through the source signal line 8 increases, an apparent resistance of the driver element 3 can be reduced. Then, the time constant, which is a product of the resistance and the floating capacitance of the source signal line 8, decreases, to shorten the time required for the change of the electric current $i_d$ to the predetermined amount in the data writing period, whereby the response speed can be improved.

FIG. 15 shows a relation between the electric current $i_d$ flowing through the source signal line 8 and the electric current $i_{OL}$ flowing through the OLED 1 at various capacitance values of capacitor 1Ct, provided that the amplitude of the gate signal line 6 is 14 V. If the capacitance ratio $((C_{gs}+Ct)/(C_{gs}+Ct+Cs))$ is 0.03, the amount of the electric current $i_d$ required to flow through the source signal line 8 is approximately five times the amount of the electric current $i_{OL}$ flowing through the OLED 1. When the capacitance of 1Ct is further increased, the ratio of the electric current $i_d$ flowing through the source signal line 8 to the electric current $i_{OL}$ flowing through the OLED 1 rises. If the capacitance ratio is 0.8, the amount of the electric current $i_d$ is 200 times the amount of the electric current $i_{OL}$, and if the capacitance ratio is increased up to 0.9, the amount of the electric current $i_d$ is 500 times the amount of the electric current $i_{OL}$.

With the increase in the amount of the electric current $i_d$ flowing through the source signal line 8, the resistance of the driver element 3 decreases, and the time required for the attainment of the predetermined amount of electric current is shortened. Hence, a higher capacitance of 1Ct results in more effective improvement of the response speed at data writing for the black level display.

The conventional technique as described above is disclosed, for example, in Japanese Patent Application Laid-Open No. 2003-140612.

As described above, in the conventional image display apparatus, a higher capacitance of 1Ct is more effective for the improvement of the response speed at data writing for the black-level display. The higher capacitance of 1Ct can be realized with a larger area of the capacitor 1Ct.

In the conventional image display apparatus, however, since there is a limit to an area usable for one pixel, the size of the capacitor 1Ct also is under a certain constraint. Hence, though the improvement in response speed is theoretically possible in the conventional image display apparatus, because of the actual manufacturing constraint, a remarkable improvement can hardly be achieved concerning the response speed at data writing for the black-level display.

SUMMARY OF THE INVENTION

An image display apparatus according to one aspect of the present invention includes a light emitting element that emits light depending on an injected electric current; a driver that includes at least a first terminal and a second terminal, and controls the light emitting element based on a potential difference, applied between the first terminal and the second terminal, of a level higher than a predetermined threshold; a storage capacitor that serves to retain a potential on the first terminal of the driver; and a controller that changes the potential on the first terminal via the storage capacitor at writing of electric data current corresponding to a display in a black level.

According to the image display apparatus of the present invention, the potential on the first terminal is changed via the storage capacitor at writing of electric data current for the black-level display. Thus, the amount of electric current for data writing increases, and unlike the conventional image display apparatus, the improvement in the response speed at data writing for the black-level display can be achieved without being affected by the area constraint per pixel.

A method according to another aspect of the present invention is of driving an image display apparatus which includes a light emitting element, a driver electrically connected to the light emitting element, and a capacitor having a first electrode and a second electrode which is connected to a gate of the driver. The method includes controlling a potential on the gate by changing a potential on the first electrode of the capacitor at writing of electric data current corresponding to a display in a black level.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 1B is a timing chart of the pixel circuit in the data writing operation;

DETAILED DESCRIPTION OF THE PREFERRED EMBODIMENTS

Exemplary embodiments of an image display apparatus and a method of driving the image display apparatus according to the present invention will be described in detail below with reference to the accompanying drawings. It should be understood that the present invention is not limited to the embodiments.

Figure 1A:
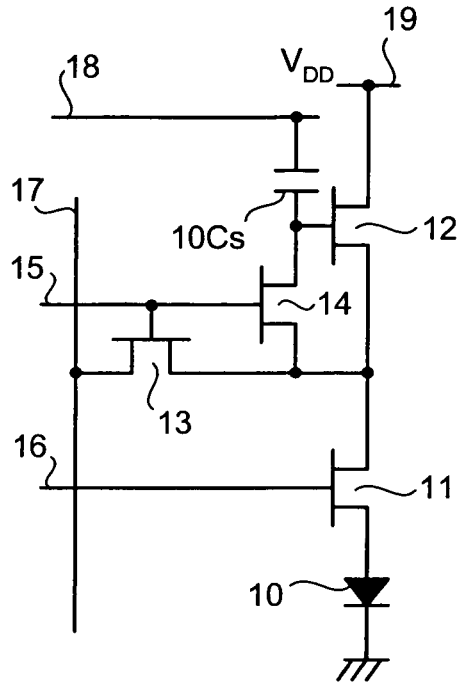
FIG. 1A is a circuit diagram of a pixel circuit corresponding to one pixel in an image display apparatus according to a first embodiment of the present invention.
Figure 1B:
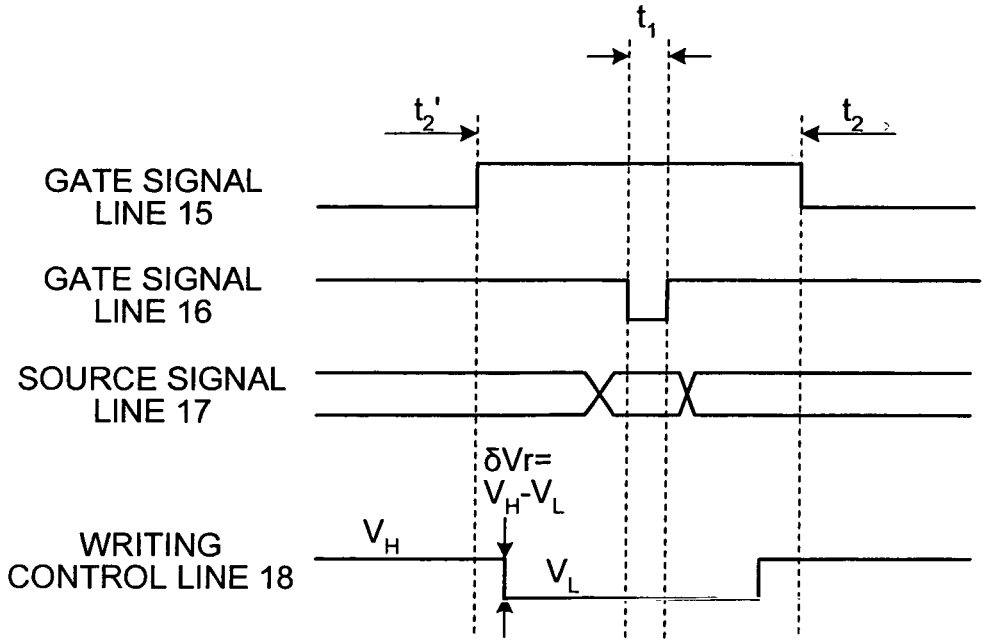
FIG. 1B is a timing chart of the pixel circuit.

FIG. 1A is a circuit diagram of a pixel circuit corresponding to one pixel in an image display apparatus according to a first embodiment of the present invention, and FIG. 1B is a timing chart of the pixel circuit. The pixel circuit in FIG. 1A includes, an OLED 10, a switching element 11, a driver element 12, a switching element 13, a switching element 14, a gate signal line 15, a gate signal line 16, a source signal line 17, a writing control line 18, an EL power source line 19, and a storage capacitor 10Cs. The switching elements and the driver element, which are for example, transistors as shown in the drawings, are not clearly shown whether each element is an n-type or a p-type. However, they should be interpreted as either n-type or p-type according to the description below.

Figure 14:
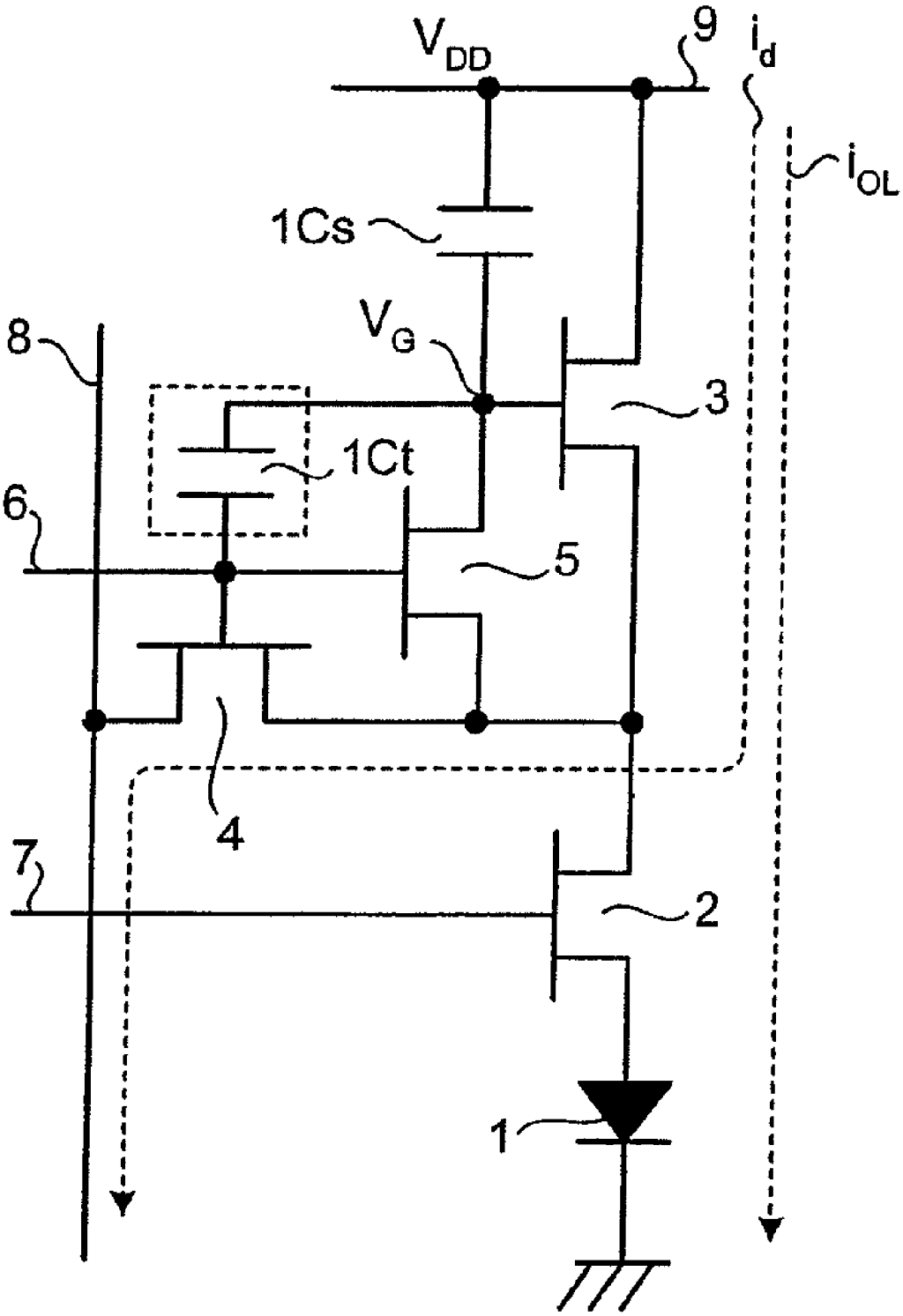
FIG. 14 is a circuit diagram of a pixel circuit corresponding to one pixel in a conventional image display apparatus.

The OLED 10, the switching element 11, the driver element 12, the switching element 13, the switching element 14, the gate signal line 15, the gate signal line 16, the source signal line 17, the EL power source line 19, and the storage capacitor 10Cs in FIG. 1A correspond to the OLED 1, the switching element 2, the driver element 3, the switching element 4, the switching element 5, the gate signal line 6, the gate signal line 7, the source signal line 8, the EL power source line 9, and the storage capacitor 1Cs in FIG. 14, respectively. The switching elements 11, 13, and 14 and the driver element 12 are p-type transistors.

The image display apparatus according to the first embodiment is different from the conventional image display apparatus in that the writing control line 18 is provided and connected to the storage capacitor 10Cs as shown in FIG. 1A.

Next, a display in a black level will be described. Following operations are performed under control of a controller (not shown). For the display in the black level, a data writing operation is first performed corresponding to a data writing period $t_1$ of FIG. 2B. In the data writing period $t_1$, the potential on the gate signal line 15 is at a high level, the potential on the gate signal line 16 is at a low level, and the potential on the writing control line 18 is at a low level ($V_L$)

Figure 2A:
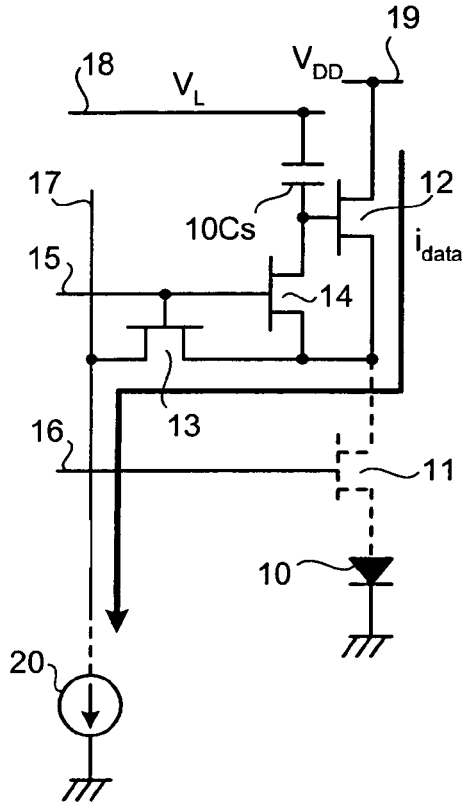
FIG. 2A is a diagram shown to describe a data writing operation in the first embodiment.
Figure 2B:
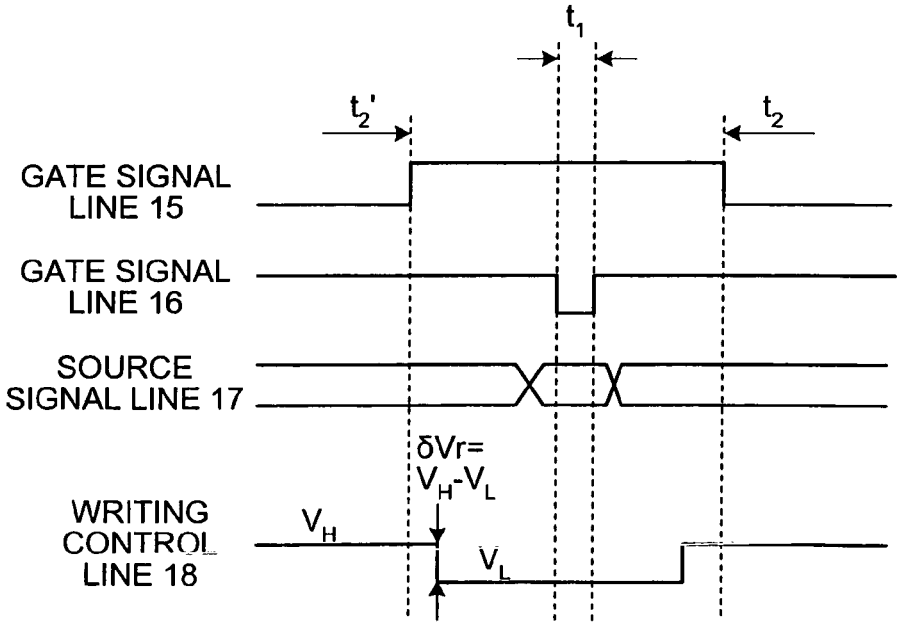

The switching element 11 is turned OFF as shown in FIG. 2A whereas the switching elements 13 and 14 are turned ON. The gate potential $V_g$ of the driver element 12 can be represented by Equation (1):

$$V_g = V_{DD} - V_T - \sqrt{\frac{2i_{data}}{\beta_L}} \tag{1}$$

where $V_{DD}$ is a power source potential applied to the EL power source line 19, $V_T$ is a threshold voltage corresponding to a driving threshold of the driver element 12, $\beta_L$ is a value in proportion to carrier mobility in the driver element 12 (hereinafter referred to as a mobility parameter), and $i_{data}$ is an electric data current represented by Equation (2):

$$i_{data}=\alpha \cdot i_{base} \tag{2}$$

The mobility parameter $\beta_L$ can be represented by Equation (3):

$$\beta_L=(W\times L)\times\mu_{eff}\times C_{ox} \tag{3}$$

where W is a channel width of the driver element 12, which is a transistor such as a Metal Oxide Semiconductor Field Effect Transistor (MOS FET), L is a channel length of the driver element 12, $\mu_{eff}$ is a carrier mobility, and $C_{ox}$ is a capacitance of a gate insulation film.

The electric data current $i_{data}$ represented by Equation (1) flows through a path formed by the EL power source line 19, the driver element 12, the switching element 13, the source signal line 17, and a power source 20 in this order. The electric data current $i_{data}$ is represented by Equation (2) where a is a coefficient, and $i_{base}$ is a black-level electric current.

Figure 8:
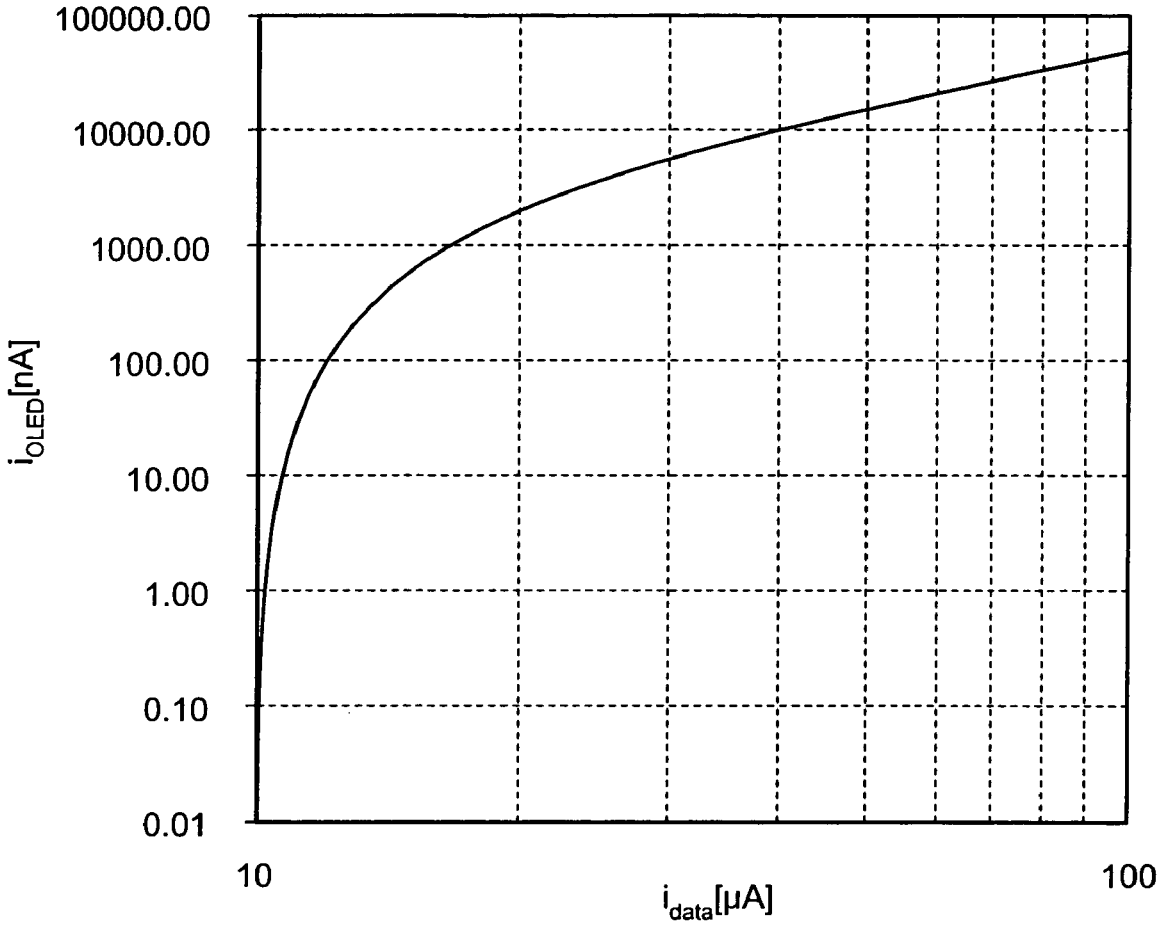
FIG. 8 is a graph of a relation between a electric data current $i_{data}$ and an electric current $i_{OLED}$ in the first embodiment.
Figure 15:
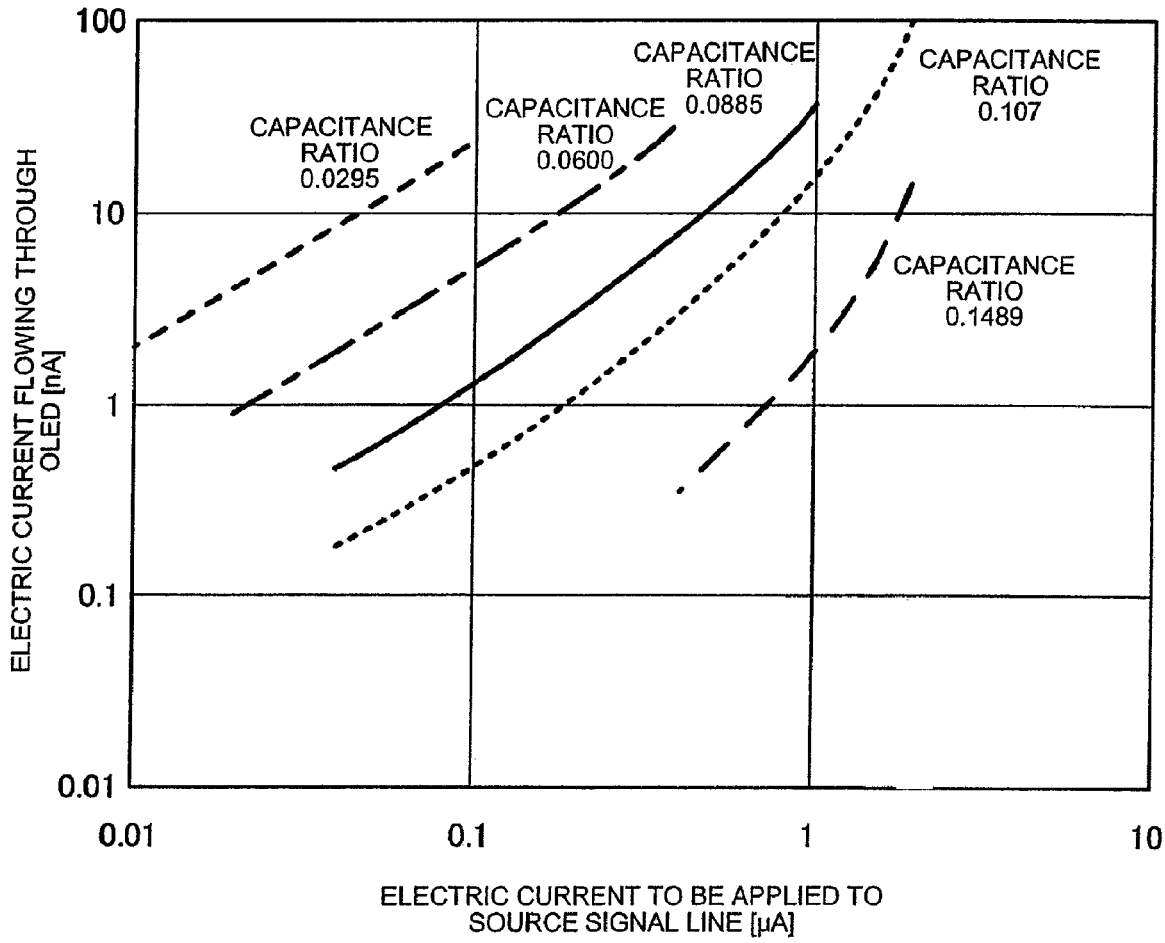
FIG. 15 is a graph of a relation between an electric current flowing through a source signal line and an electric current flowing through an OLED in the conventional image display apparatus.

Even if the electric data current $i_{data}$ is made larger, the electric current $i_{OLED}$ flowing through the OLED 10 at the light emission can be maintained at a level for the black level, since the potential on the writing control line 18 at the data writing is lower by an amount of $\delta V_r$ (described later in detail) than the potential on the writing control line 18 at the light emission of the OLED 10 in the previous process. As shown in FIG. 8, for example, in the first embodiment the black level can be maintained even when the amount of $i_{data}$ is set to 10 μA, and the response speed is enhanced to approximately ten times that of the conventional image display apparatus ($i_d$=approximately 1 μA; see FIG. 15).

Figure 3A:
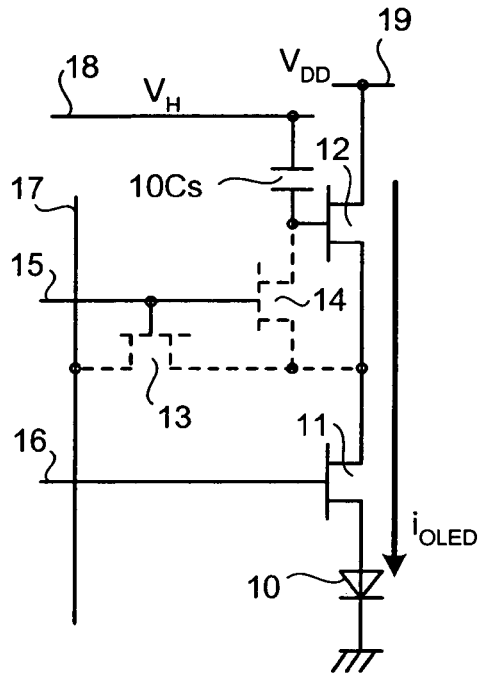
FIG. 3A is a diagram shown to describe a light emitting operation in the first embodiment.
Figure 3B:
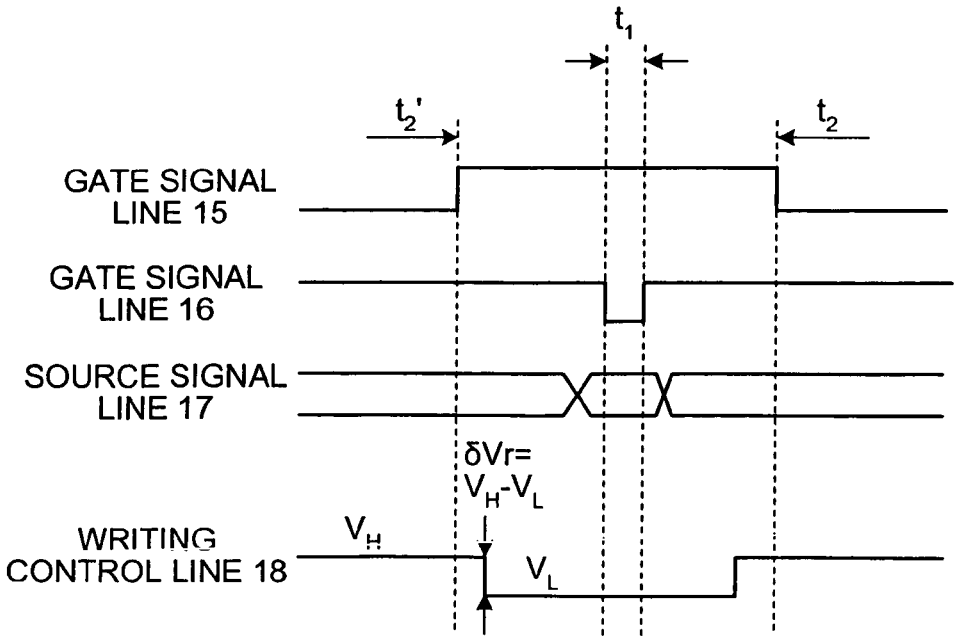
FIG. 3B is a timing chart of the pixel circuit in the light emitting operation.

Then, a light emitting operation is performed corresponding to a light emitting period $t_2$ of FIG. 3B. In the light emitting period $t_2$, a signal on the gate signal line 15 attains a low level, a potential on the gate signal line 16 is at a high level, a potential on the source signal line 17 is at a high level, and a potential on the writing control line 18 is at a high level ($V_H$). The potential difference $\delta V_r$ on the writing control line 18 is represented by Equation (4):

$$\delta V_r = \sqrt{\frac{2i_{base}}{\beta_{ave}}} \tag{4}$$

where $\beta_{ave}$ is an average of the mobility parameter, i.e., an average value of the mobility parameter $\beta_L$ (see Equation (2)) described above, and $i_{base}$ is the black-level electric current as described above.

The value of $\delta V_r$ can be found as follows. The gate potential $V_g$ of the driver element 12 at light emission is found from Equation (5):

$$V_g = V_{DD} - V_T - \sqrt{\frac{2i_{data}}{\beta_L}} + \delta V_r \tag{5}$$

For the maintenance of the black level, the gate potential $V_g$ needs to be at the level of $V_{DD}-V_T$. Hence, a relation of $\delta V_r=(2\times i_{data}/\beta_L)^{1/2}$ holds.

Here, since the electric data current $i_{data}$ to be written for the display in the black level is defined as $i_{base}$, the above expression can be rewritten to another expression $\delta V_r=(2\times i_{base}/\beta_L)^{1/2}$. Since the mobility parameter $\beta_L$ is different for each driver element, a most appropriate value of $\delta V_r$ is also different for each pixel. Hence, theoretically it appears to be preferable to connect a separate writing control line 18 to each pixel and to separately assign a different value of $\delta V_r$ for each pixel. Then, however, the circuit structure of the control line 18 and hence, the manner of driving the same become extremely complicated. Thus, preferably the writing control line 18 is shared among pixels which are arranged in a same line or the writing control line 18 is commonly connected to all pixels so that $\delta V_r$ of the same value is assigned to all pixels.

In order to assign the same $\delta V_r$ to all pixels, the value of $\beta_L$ is also required to be same among all pixels. Hence, the mobility parameter $\beta_L$ of each pixel is replaced with $\beta_x$. As a result, a relation $(2\times i_{base}/\beta_x)^{1/2}$ holds. Preferably the average value $\beta_{ave}$ of the mobility parameter $\beta$ is employed as the value of $\beta_{ave}$ for all pixels as is shown by Equation (4). Alternatively, $\beta_x$ may be set in the range of $0.5\beta_{ave} \leqq \beta_x \leqq 1.5\beta_{ave}$. Still alternatively, $\beta_x$ may preferably be set in the range of $0.9\beta_{ave} \leqq \beta_x \leqq 1.1\beta_{ave}$.

As shown in FIG. 3A, the switching element 11 is turned ON, whereas the switching elements 13 and 14 are turned OFF, and the electric current $i_{OLED}$ represented by Equation (6) flows through a path formed by the EL power source line 19, the driver element 12, the switching element 11, and the OLED 10 in this order.

$$i_{OLED} = \frac{\beta_L}{2}(V_{sg} - V_T)^2 = \left(\sqrt{i_{data}} - \sqrt{\frac{\beta_L}{2}} \cdot \delta V_r\right)^2 = \left(\sqrt{i_{data}} - \sqrt{\frac{\beta_L}{\beta_{ave}} \cdot i_{base}}\right)^2 = i_{base}\left(\sqrt{\alpha} - \sqrt{\frac{\beta_L}{\beta_{ave}}}\right)^2 \quad (6)$$

In Equation (6), $V_{sg}$ is a source-to-gate voltage of the driver element 12, $V_T$ is a threshold voltage corresponding to a driving threshold of the driver element 12. When $\alpha$ is one and $\beta_{ave}$ is $\beta_L$ in Equation (6), with the substitution of these values into the last part of Equation (6), the value of the electric current $i_{OLED}$ can be given as zero, which means a display in a perfect black level.

Figure 4A:
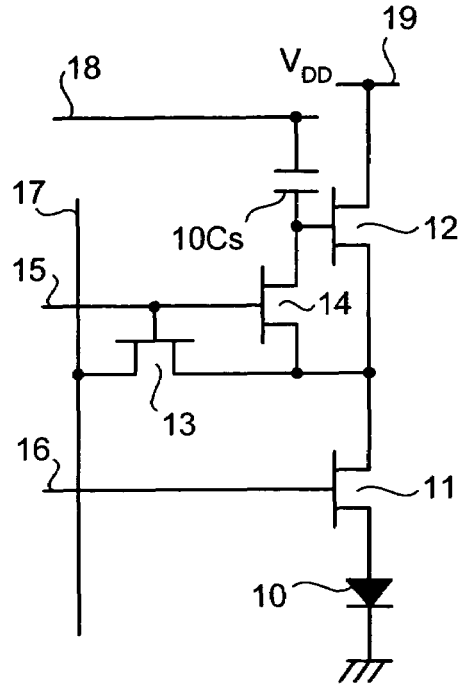
FIG. 4A is a diagram shown to describe a first phase of calculation of an average mobility parameter $\beta_{ave}$ in the first embodiment.
Figure 4B:
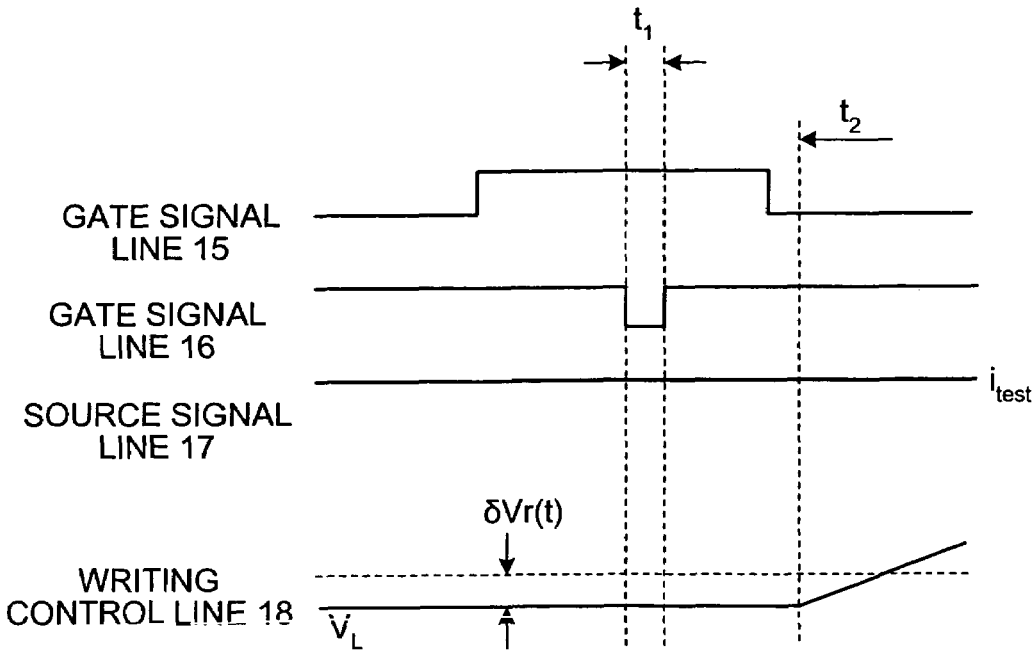
FIG. 4B is a timing chart of the pixel circuit in the first phase of the calculation.

As shown in FIGS. 4A and 4B, the average mobility parameter $\beta_{ave}$ is found after writing of a test electric current $i_{test}$ into all pixel circuits in the image display apparatus, light emission of the OLED 10, temporal changes of potential on the writing control line 18, and the calculation of the mobility parameter in each pixel circuit.

Figure 5A:
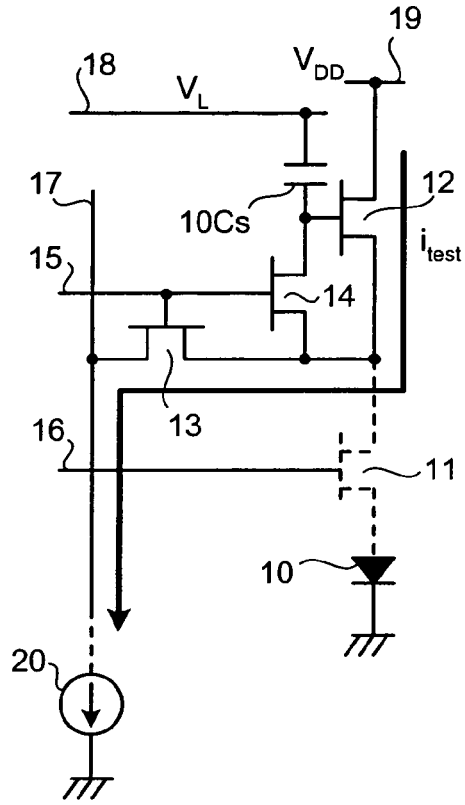
FIG. 5A is a diagram shown to describe a second phase of calculation of the average mobility parameter $\beta_{ave}$ in the first embodiment.
Figure 5B:
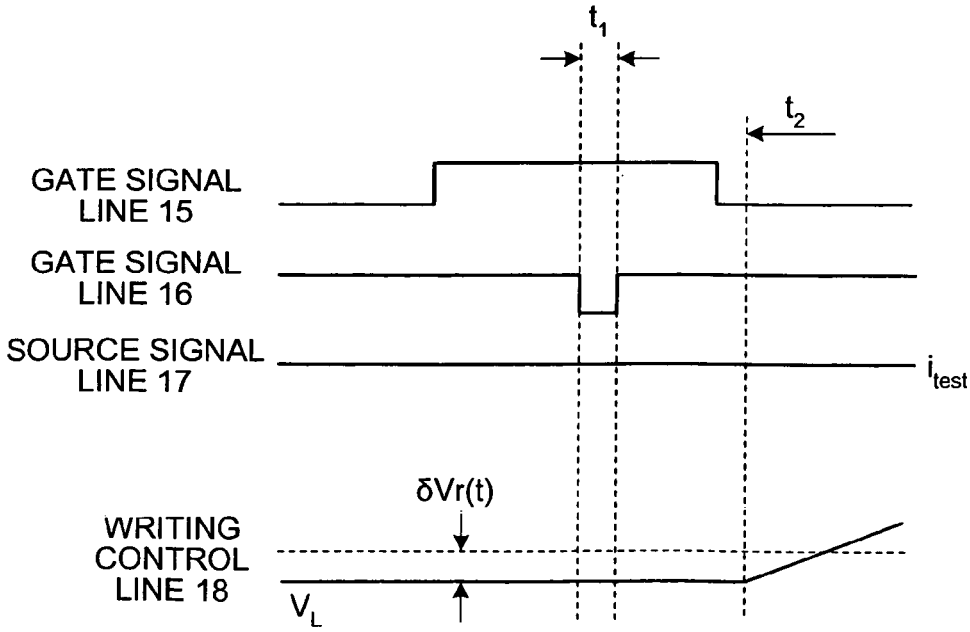
FIG. 5B is a timing chart of the pixel circuit in the second phase of the calculation.

Specifically as shown in FIGS. 5A and 5B, when the switching elements 13 and 14 are turned ON and the switching element 11 is turned OFF, the test electric current $i_{test}$ flows through the source signal line 17. Here, the gate potential $V_g$ of the driver element 12 can be represented by Equation (7):

$$V_g = V_{DD} - V_T - \sqrt{\frac{2i_{test}}{\beta_L}} \quad (7)$$

Figure 6A:
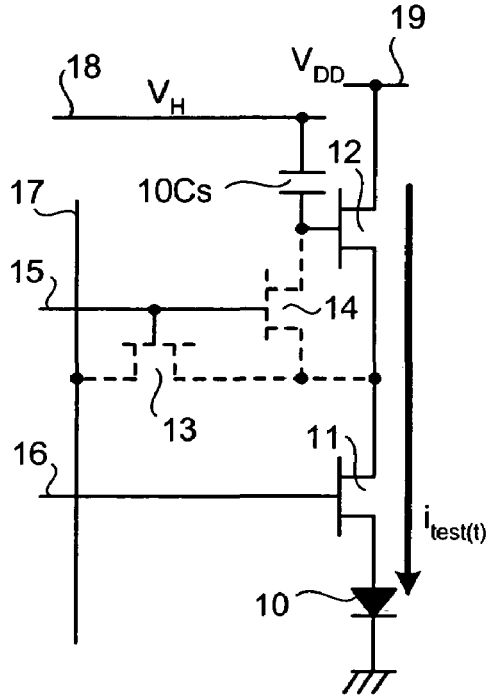
FIG. 6A is a diagram shown to describe a third phase of calculation of the average mobility parameter $\beta_{ave}$ in the first embodiment.
Figure 6B:
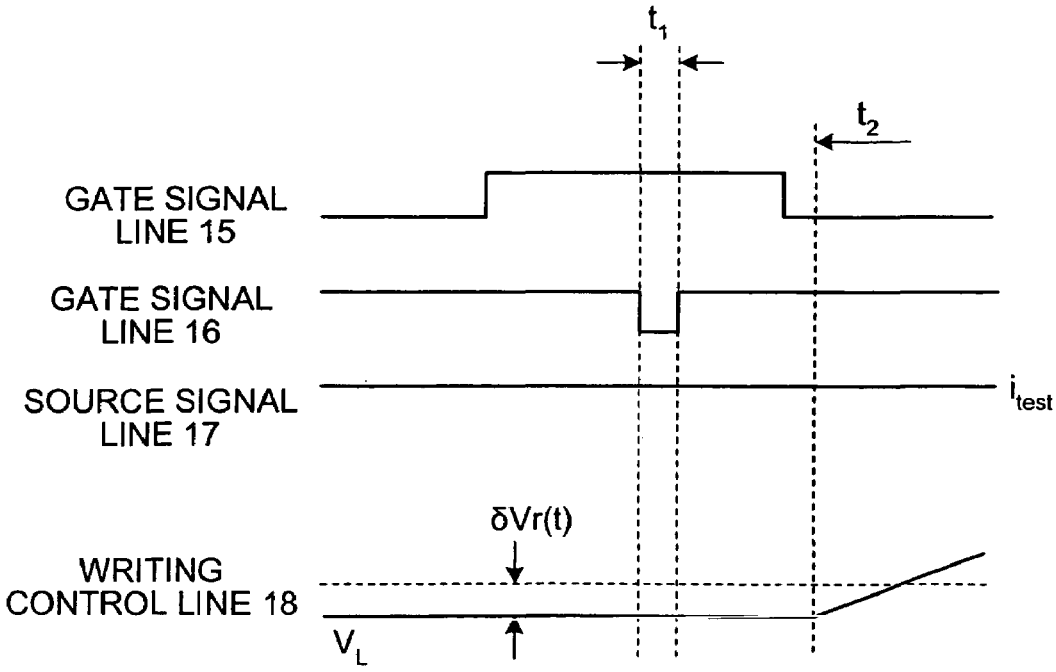
FIG. 6B is a timing chart of the pixel circuit in the third phase of the calculation.

Then, when the switching elements 13 and 14 are turned OFF and the switching element 11 is turned ON as shown in FIGS. 6A and 6B, the test electric current $i_{test}(t)$ flows through the OLED 10 to cause light emission of the OLED 10. Here, the gate potential $V_g$ of the driver element 12 can be represented by Equation (8):

$$V_g = V_{DD} - V_T - \sqrt{\frac{2i_{test}}{\beta_L}} + \delta V_r(t) \quad (8)$$

where $i_{test}$ takes a value shown in FIG. 5A.

If, in the light emitting period, the potential difference $\delta V_r$ of the writing control line 18 is changed until the black level is attained at $\delta V_r(t)$ (see Expression (9)), in other words, if the test electric current $i_{test}(t)$ represented by Equation (10) is zero (see Equation (11)) and the OLED 10 does not emit light, the mobility parameter $\beta_L$ of the pertinent pixel circuit can be represented by Equation (12) where $\delta V_r(t)$ is a potential difference at an instant the black level is attained.

$$\delta V_r(t) \geq \sqrt{\frac{2i_{test}}{\beta_L}} \quad (9)$$

$$i_{test}(t) = \frac{\beta_L}{2}(V_{sg} - V_T)^2 = \left(\sqrt{i_{test}} - \sqrt{\frac{\beta_L}{2}} \cdot \delta V_r(t)\right)^2 \quad (10)$$

$$i_{test}(t) = 0 \quad (11)$$

$$\beta_L = \frac{2i_{test}}{(\delta V_r(t))^2} \quad (12)$$

Figure 7A:
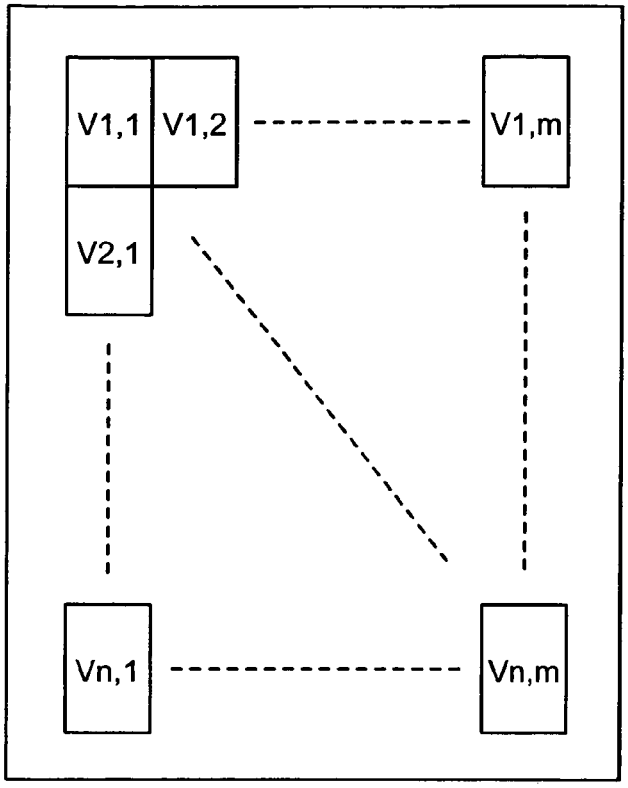
FIG. 7A is a diagram shown to describe a fourth phase of calculation of the average mobility parameter $\beta_{ave}$ in the first embodiment.
Figure 7B:
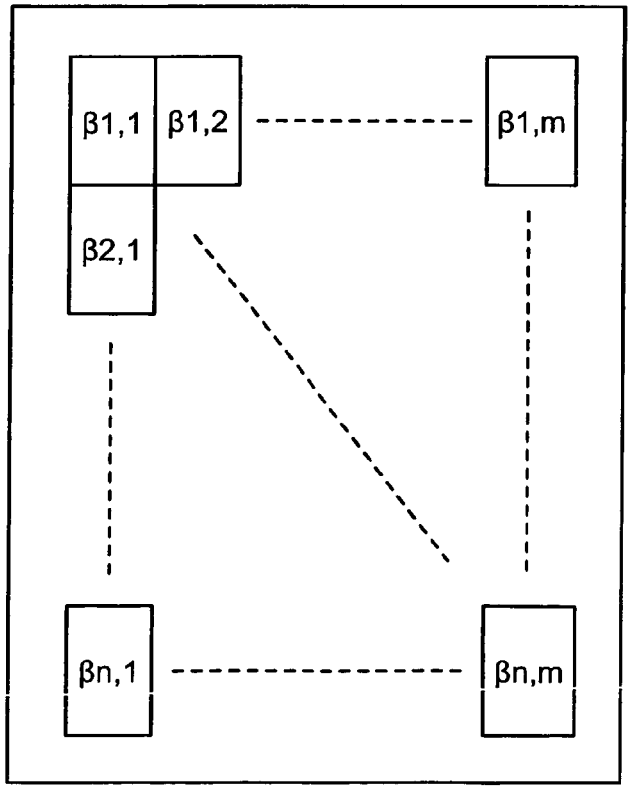
FIG. 7B is a timing chart of the pixel circuit in the fourth phase of the calculation.

In practice, distribution of potential differences $dV_r(t)$ (potential differences V1,1–Vn,m) at the transition to the black level can be obtained for each pixel circuit as shown in FIG. 7A. Then, with the substitution of each value of potential difference (V1,1–Vn,m) and a known value of the test electric current $i_{test}$ into $\delta V_r(t)$ of Equation (12), the mobility parameter $\beta_L$ for each pixel circuit is found. Thus, the distribution of the mobility parameter $\beta_L$ can be found for all pixel circuits as shown in FIG. 7B.

Then the average mobility parameter $\beta_{ave}$ is found based on the distribution of the mobility parameter $\beta_L$. Specifically, each value (each of $\beta$1,1–$\beta$n,m) in the distribution of the mobility parameter $\beta_L$ is found and added, and the sum is divided by a number of all pixel circuits (sample number) to provide the average mobility parameter $\beta_{ave}$.

As described above, in the first embodiment, the gate potential $V_g$ of the driver element 12 is changed via the storage capacitor 10Cs at writing of electric data current for the display in the black level, to increase the amount of electric current $i_{data}$ for the data writing. Thus, unlike the conventional image display apparatus, the response speed at the data writing for the display in the black level can be improved without being affected by the area constraint per pixel.

Figure 9A:
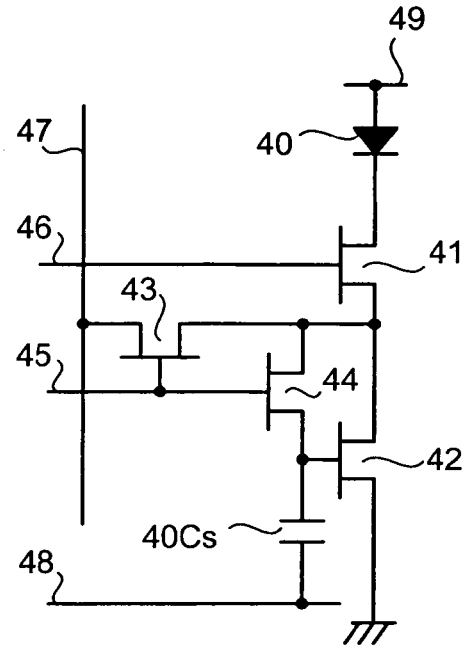
FIG. 9A is a circuit diagram of a pixel circuit corresponding to one pixel in an image display apparatus according to a second embodiment of the present invention.
Figure 9B:
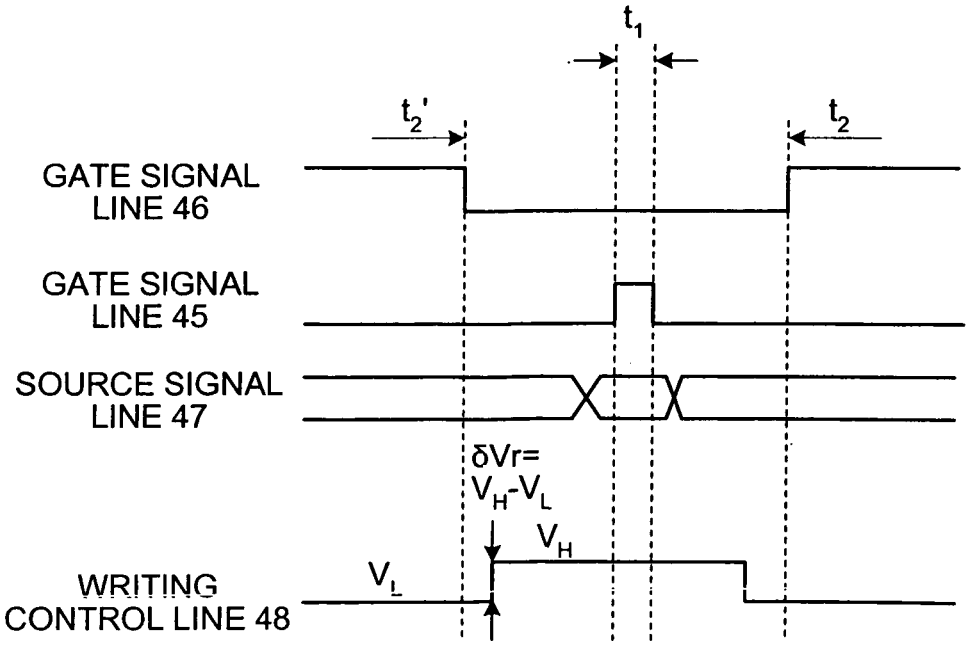
FIG. 9B is a timing chart of the pixel circuit.

In the description of the first embodiment above, the circuit with the structure of FIG. 1 is described. However, the circuit may take a structure shown in FIG. 9A. Hereinbelow, the exemplary circuit of FIG. 9A will be described as a second embodiment. FIG. 9A is a circuit diagram of a pixel circuit corresponding to one pixel in an image display apparatus according to the second embodiment of the present invention, and FIG. 9B is a timing chart of the pixel circuit. In FIG. 9A, the pixel circuit includes an OLED 40, a switching element 41, a driver element 42, a switching element 43, a switching element 44, a gate signal line 45, a gate signal line 46, a source signal line 47, a writing control line 48, an EL power source line 49, and a storage capacitor 40Cs.

The OLED 40, the switching element 41, the driver element 42, the switching element 43, the switching element 44, the gate signal line 45, the gate signal line 46, the source signal line 47, the writing control line 48, the EL power source line 49, and the storage capacitor 40Cs in FIG. 9 correspond with the OLED 10, the switching element 11, the driver element 12, the switching element 13, the switching element 14, the gate signal line 15, the gate signal line 16, the source signal line 17, the writing control line 18, the EL power source line 19, and the storage capacitor 10Cs in FIG. 1, respectively. The switching elements 41, 43, and 44, and the driver element 42 are n-type transistors.

Figure 10A:
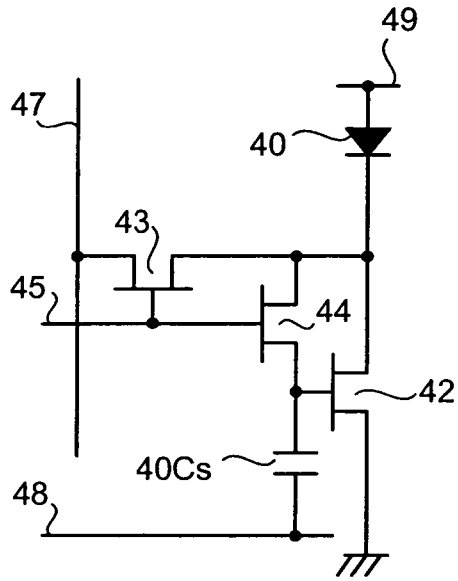
FIG. 10A is a circuit diagram of a pixel circuit corresponding to one pixel in an image display apparatus according to a third embodiment of the present invention.
Figure 10B:
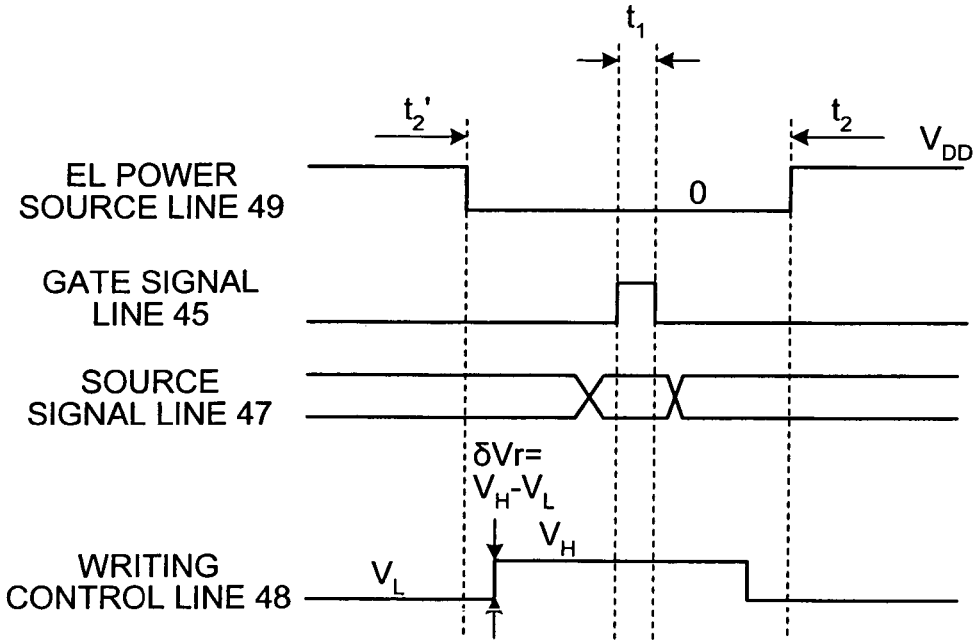
FIG. 10B is a timing chart of the pixel circuit.

In the description of the second embodiment above, the circuit with the structure of FIG. 9A is described. However, the circuit may take a structure shown in FIG. 10A and its timing chart shown in FIG. 10B where the circuit does not include the switching element 41 and the gate signal line 46 (third embodiment).

Figure 11A:
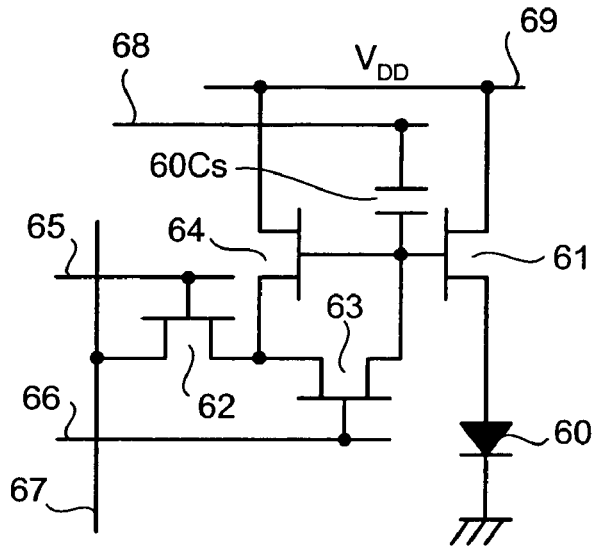
FIG. 11A is a circuit diagram of a pixel circuit corresponding to one pixel in an image display apparatus according to a fourth embodiment of the present invention.
Figure 11B:
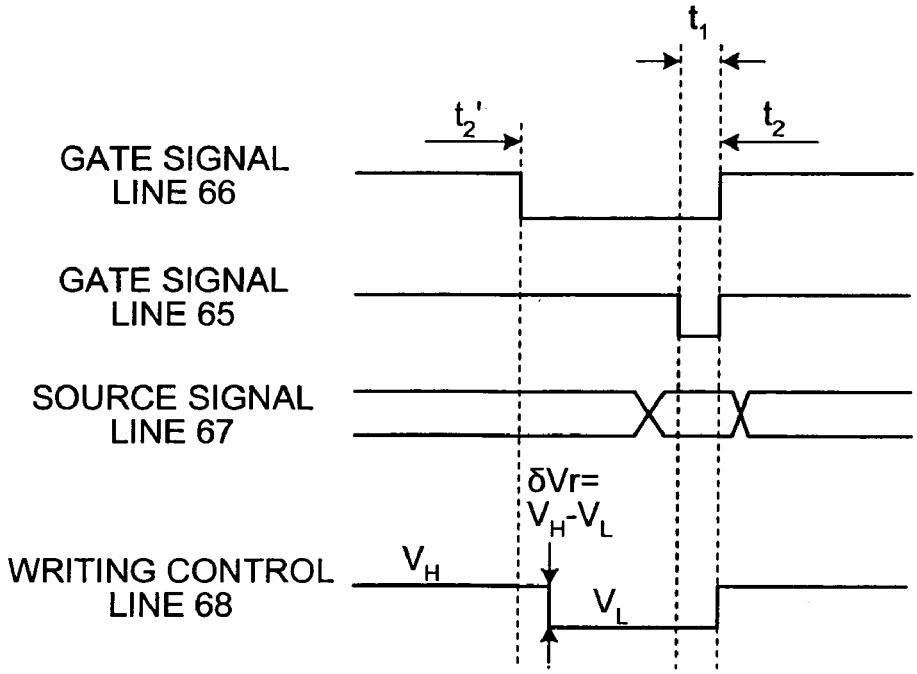
FIG. 11B is a timing chart of the pixel circuit.

In the description of the first embodiment above, the circuit with the structure of FIG. 1A is described. However, the circuit may take a current-mirror type structure shown in FIG. 11A. The exemplary circuit of FIG. 11A will be described below as a fourth embodiment. FIG. 11A is a circuit diagram of a pixel circuit corresponding to one pixel in an image display apparatus according to the fourth embodiment of the present invention, and FIG. 11B is a timing chart of the pixel circuit. In FIG. 11A, the pixel circuit includes an OLED 60, a driver element 61, a switching element 62, a switching element 63, a driver element 64, a gate signal line 65, a gate signal line 66, a source signal line 67, a writing control line 68, an EL power source line 69, a power source 70, and a storage capacitor 60Cs. The driver elements 61 and 64 form a current mirror circuit. The driver elements 61 and 64, and the switching elements 62 and 63 are p-type transistors.

Figure 12A:
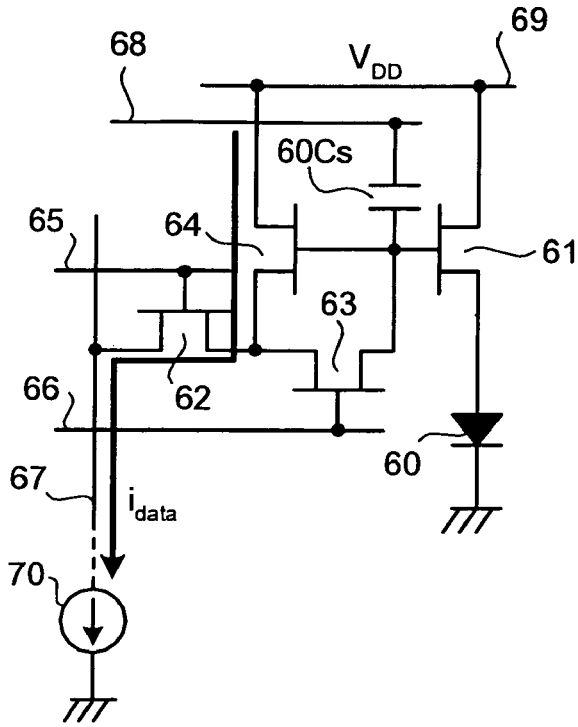
FIG. 12A is a diagram shown to describe a data writing operation in the fourth embodiment.
Figure 12B:
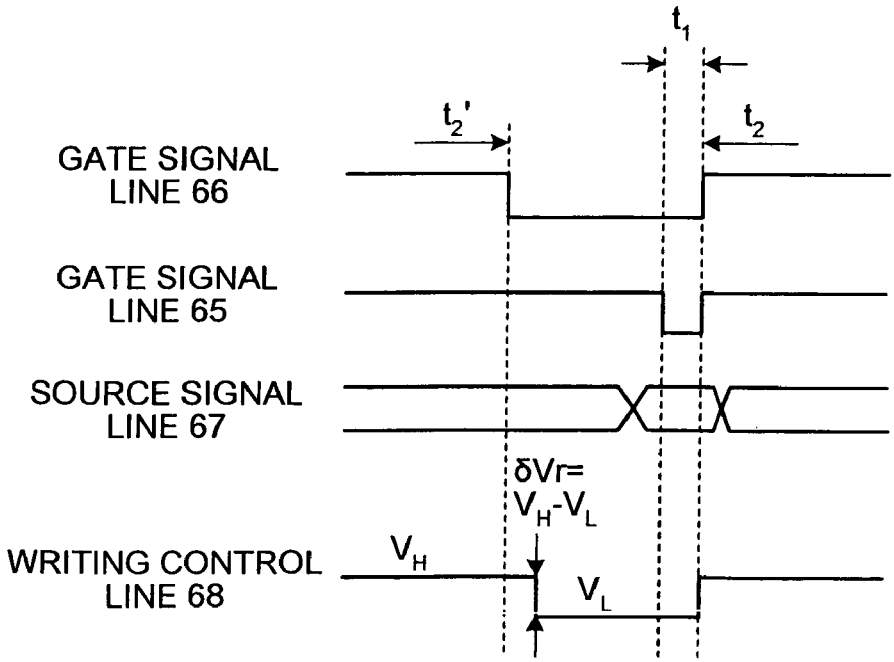
FIG. 12B is a timing chart of the pixel circuit in the data writing operation.

Next, the display in the black level will be described. At the display in the black level, a data writing operation is first performed corresponding to a data writing period $t_1$ in FIG. 12. In the data writing period $t_1$, a potential on the gate signal line 66 is at a low level, a potential on the gate signal line 65 is at a low level, and a potential on the writing control line 68 is at a low level ($V_L$).

Then, the gate potential $V_g$ of the driver element 64 can be represented by Equation (1) described above. The amount of electric data current $i_{data}$ flowing during this period is represented by Equation (2) described above. Similarly to the first embodiment, the electric data current $i_{data}$ flowing at data writing is as high as 10 μA as shown in FIG. 8.

Figure 13A:
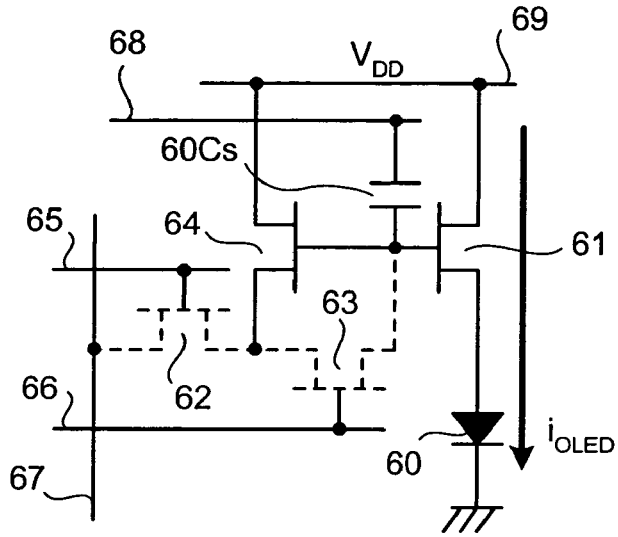
FIG. 13A is a diagram shown to describe a light emitting operation in the fourth embodiment.
Figure 13B:
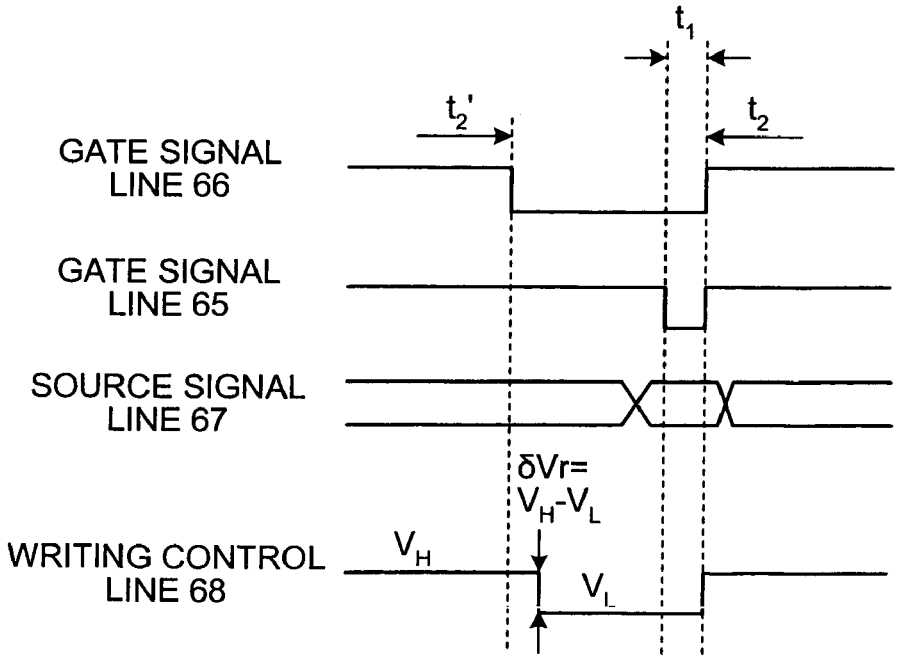
FIG. 13B is a timing chart of the pixel circuit in the light emitting operation.

Next, a light emitting operation is performed corresponding to a light emitting period $t_2$ of FIG. 13B. In the light emitting period $t_2$, a signal on the gate signal line 66 attains a high level, a potential on the gate signal line 65 is at a high level, a potential on the source signal line 67 is at a high level, and a potential on the writing control line 68 is at a high level ($V_H$). Here the potential difference $\delta V_r$ of the writing control line 68 can be represented by Equation (4) as described above. In addition, the electric current $i_{OLED}$ flowing through the OLED 60 can be represented by Equation (6'):

$$i_{OLED} = \frac{\kappa\beta_L}{2}(V_{sg} - V_T)^2 = \kappa\left(\sqrt{i_{data}} - \sqrt{\frac{\beta_L}{2}} \cdot \delta V_r\right)^2 \tag{6'}$$

$$= \kappa\left(\sqrt{i_{data}} - \sqrt{\frac{\beta_L}{\beta_{ave}} \cdot i_{base}}\right)^2 = \kappa \cdot i_{base}\left(\sqrt{\alpha} - \sqrt{\frac{\beta_L}{\beta_{ave}}}\right)^2$$

Here, κ can be represented as κ=(Wb/Lb)/(Wa/La) where Wa and Wb are channel widths of driver elements 61 and 64, and La and Lb are channel lengths thereof. The gate potential $V_g$ of the driver element 61 is represented by Equation (5) as described above.

As can be seen from the foregoing, the image display apparatus according to the present invention is useful for the improvement in the response speed at the display in the black level.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image display apparatus comprising:

a light emitting element;

a driver that includes at least a first terminal and a second terminal, and controls the light emitting element based on a potential difference applied between the first terminal and the second terminal;

a storage capacitor having a first electrode and a second electrode which is electrically connected to the driver, the storage capacitor serving to retain a potential of the first terminal of the driver;

a current source that flows through the driver, a data current corresponding to a display in a black level in order to set a voltage across the first and the second terminals of the driver to a first voltage;

a controller that controls a potential of the first electrode of the storage capacitor to change the voltage across the first and the second terminals of the driver from the first voltage to a second voltage, the second voltage being different from the first voltage; and a writing control line that is connected to the first electrode of the storage capacitor, wherein the light emitting element emits light based on the second voltage;

wherein the writing control line is commonly connected to all pixels; and wherein the potential difference $\delta V_r$ is represented by an expression $(2\cdot i_{base}/1.1\beta_L)^{1/2} \leqq \delta V_r \leqq (2\cdot i_{base}/0.9\beta_L)^{1/2}$, where $i_{base}$ is the amount of electric current applied at the data writing corresponding to the display in the black level, and $\beta_L$ is a value in proportion to mobility of the driver in each pixel.

2. The image display apparatus according to claim 1, wherein the controller changes a potential of the first electrode of the storage capacitor through the writing control line.

3. The image display apparatus according to claim 1, wherein the driver is an n-type transistor, and the potential of the first electrode of the storage capacitor is higher than a potential of the first electrode of the storage capacitor.

4. The image display apparatus according to claim 1, wherein the driver is a p-type transistor, and the potential of the first electrode of the storage capacitor is lower than a potential electrode of the storage capacitor.

5. The image display apparatus according to claim 1, wherein a potential difference $\delta V_r$ between the potential of the writing control line at light emission by the light emitting element and the potential of the writing control line at writing of the electric data current corresponding to the display in the black level, where the potential difference $\delta V_r$ is substantially same in all pixels.

6. The image display apparatus according to claim 1, wherein the light emitting element is an organic light-emitting diode.

7. The image display apparatus according to claim 1, wherein the driver is of a current mirror structure.

8. The image display apparatus according to claim 1, wherein the data current corresponding to the display in the black level, which is supplied by the current source, does not pass through the light emitting element.

9. An image display apparatus comprising:

a light emitting element that emits light depending on an injected electric current;

a driver that includes at least a first terminal and a second terminal, and controls the light emitting element based on a potential difference, applied between the first terminal and the second terminal, of a level higher than a predetermined threshold;

a storage capacitor that serves to retain a potential on the first terminal of the driver;

a controller that changes the potential on the first terminal via the storage capacitor at writing of electric data current corresponding to a display in a black level;

a writing control line that is connected to one end of the storage capacitor; and wherein the writing control line is commonly connected to all pixels, wherein the potential difference $\delta V_r$ is represented by an expression $(2i_{base}/1.5\beta_{ave})^{1/2}<=\delta V_r<=(2i_{base}/0.5\beta_{ave})^{1/2}$, where $i_{base}$ is the amount of electric current applied at the data writing corresponding to the display in the black level, and $\beta_{ave}$ is an average value of values in proportion to mobility of the driver in each pixel.

10. An image display apparatus comprising:

a light emitting element that emits light depending on an injected electric current;

a driver that includes at least a first terminal and a second terminal, and controls the light emitting element based on a potential difference, applied between the first terminal and the second terminal, of a level higher than a predetermined threshold;

a storage capacitor that serves to retain a potential on the first terminal of the driver;

a controller that changes the potential on the first terminal via the storage capacitor at writing of electric data current corresponding to a display in a black level; and a writing control line that is connected to one end of the storage capacitor;

wherein the writing control line is separately connected to each pixel, wherein a potential difference $\delta V_r$ between the potential on the writing control line at light emission of the light emitting element and the potential on the writing control line at writing of electric data current corresponding to the display in the black level is different value for each pixel, and wherein the potential difference $\delta V_r$ is represented by an expression $(2i_{base}/1.5\beta_L)^{1/2}<=\delta V_r<=(2i_{base}/0.5\beta_L)^{1/2}$, where $i_{base}$ is the amount of electric current applied at the data writing corresponding to the display in the black level, and $\beta_L$ is an average value of values in proportion to mobility of the driver in each pixel.

11. An image display apparatus comprising:

a light emitting element a driver that includes at least a first terminal and a second terminal, and controls the light emitting element based on a potential difference, applied between the first terminal and the second terminal;

a storage capacitor having a first electrode and a second electrode which is electrically connected to the driver, the storage capacitor serving to retain a potential of the first terminal of the driver;

a current source that flows through the driver, a data current corresponding to a display in a black level in order to set a voltage across the first and the second terminals of the driver to a first voltage;

a controller that controls a potential of the first electrode of the storage capacitor to change the voltage across the first and the second terminals from the first voltage to a second voltage which is different from the first voltage; and a writing control line that is connected to the first electrode of the storage capacitor, wherein the light emitting element emits light based on the second voltage;

wherein the writing control line is separately connected to each pixel;

wherein a potential difference $\delta V_r$ between the potential of the writing control line at light emission of the light emitting element in the previous process and the potential on the writing control line at writing of electrical-data current corresponding to the display in the black level is different value for each pixel; and wherein the potential difference $\delta V_r$ is represented by an expression $(2\cdot i_{base}/1.1\beta_L)^{1/2}\leqq\delta V_r\leqq(2\cdot i_{base}/0.9\beta_L)^{1/2}$, where $i_{base}$ is the amount of electric current applied at the data writing corresponding to the display in the black level, and $\beta_L$ is an average value of values in proportion to mobility of the driver in each pixel.

* * * * *

UNITED STATES PATENT AND TRADEMARK OFFICE

CERTIFICATE OF CORRECTION

PATENT NO. : 7,636,073 B2
APPLICATION NO. : 11/159328
DATED : December 22, 2009
INVENTOR(S) : Ono et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1217 days.

Signed and Sealed this

Ninth Day of November, 2010

David J. Kappos

David J. Kappos
*Director of the United States Patent and Trademark Office*